United States Patent [19]

Borg

[11] Patent Number: 4,701,753

[45] Date of Patent: Oct. 20, 1987

[54] VIDEO DISPLAY TERMINAL WITH MULTI FREQUENCY DOT CLOCK

[75] Inventor: Arthur N. Borg, Lake Forest, Ill.

[73] Assignee: Zenith Electronics Corporation, Glenview, Ill.

[21] Appl. No.: 782,640

[22] Filed: Oct. 1, 1985

[51] Int. Cl.[4] ..... G09G 1/16

[52] U.S. Cl. ..... 340/731; 340/735; 340/748; 340/749

[58] Field of Search ..... 340/748, 789, 813, 814, 340/731, 735, 749; 358/22, 152

[56] References Cited

U.S. PATENT DOCUMENTS 4,357,604 11/1982 Imazeki et al. ..... 340/749

4,430,649 2/1984 Leininger ..... 340/731

4,574,279 3/1986 Roberts ..... 340/748

4,575,717 3/1986 Fedele ..... 340/749

4,599,611 7/1986 Bowker et al. ..... 340/721

*Primary Examiner*—Gerald L. Brigance

[57] ABSTRACT

A video display terminal for selectively displaying a format of 80 characters per line and a format of 132 characters per line includes a microprocessor driven controller, a VCO for supplying the dot clock frequency, a frequency divider connected between the VCO and the controller and a crystal controlled phase detector coupled between the horizontal deflection signal output of the controller and the input of the VCO for smoothly changing the dot clock frequency in response to software induced changes in the controller.

4 Claims, 1 Drawing Figure

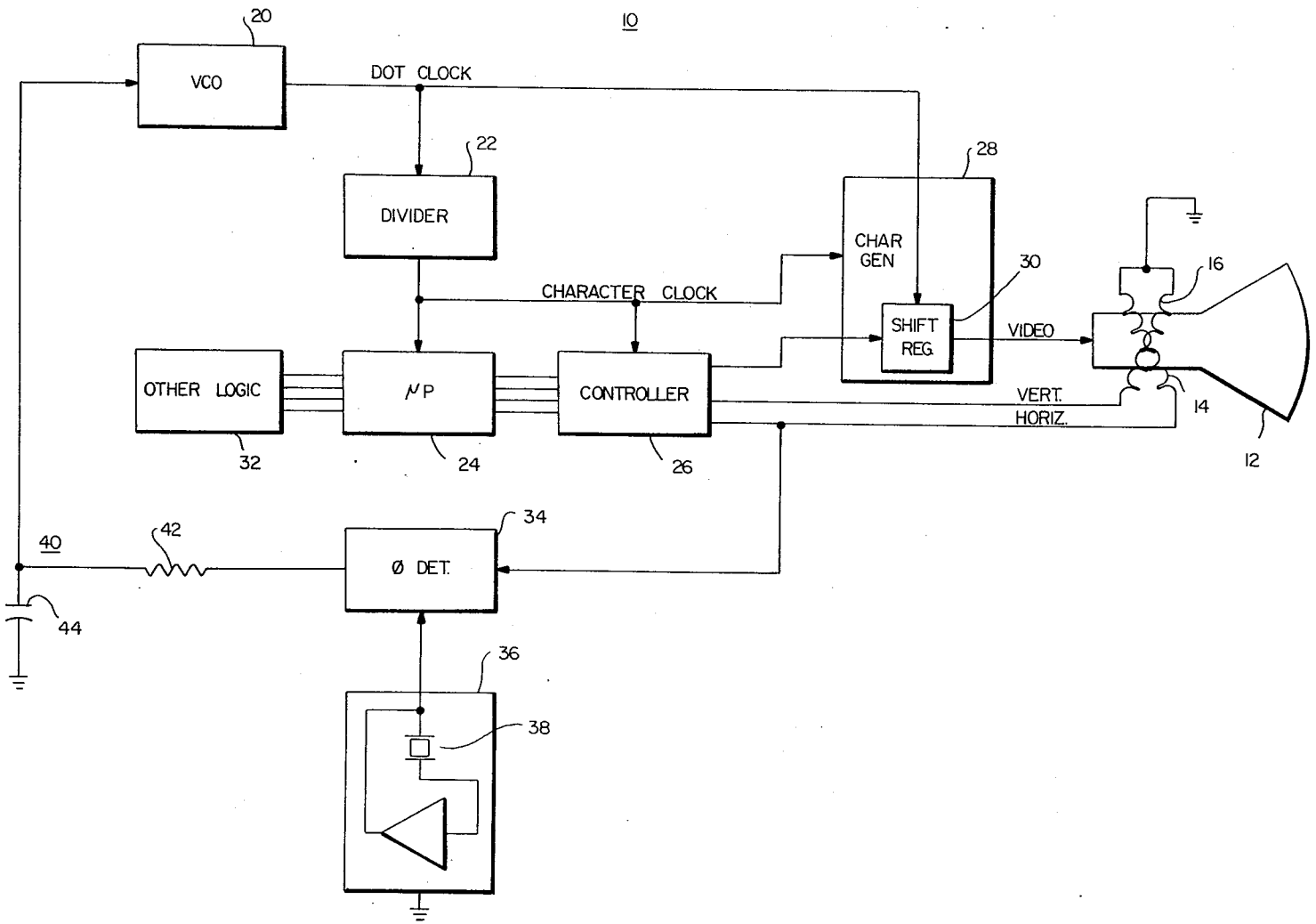
10
12
14
16
VIDEO
VERT.
HORIZ.
28
30
CHAR GEN
SHIFT REG.
CHARACTER CLOCK
CONTROLLER
26
DOT CLOCK
22
DIVIDER
24
μP
34
Ø DET.
36
38
20
VCO
OTHER LOGIC
32
42
40
44

VIDEO DISPLAY TERMINAL WITH MULTI FREQUENCY DOT CLOCK

BACKGROUND OF THE INVENTION

This invention relates generally to video display terminals and particularly to video display terminals that are capable of displaying video data in different formats.

Video display terminals (VDTs) have come into widespread use as the communication media in computer systems requiring user interaction. Nearly every computer system includes a VDT for displaying information to a user. Generally a VDT displays a screen format of 80 characters per line and 25 lines per screen. There are, however, many occasions when a different format is desired, for example, a format of 132 characters per line on a 25 line screen is common. While many VDTs are capable of producing more than one display format, those of interest to this invention change the number of characters per line, but maintain a fixed number of lines per screen, that is the horizontal and vertical deflection frequencies for the cathode ray tube (CRT) display device remain fixed.

The VDT generally has a high frequency crystal oscillator for establishing system timing. This frequency is referred to as the "dot clock" frequency. VDTs having the capability of providing two different display formats include an additional crystal oscillator for generating a different dot clock frequency and a switching arrangement for changing the dot clock frequency by switching between the two oscillators.

Most VDTs are microprocessor driven and include apparatus for deriving the clock signal for the microprocessor by dividing the dot clock frequency. The microprocessor in turn operates on a controller for generating the required cathode ray tube deflection and video signals. The VDT includes a program display memory, often referred to as a screen memory, that "keeps track of" what is on, or is to be put on, the screen. The microprocessor provides the desired information which is stored in the screen memory and the CRT controller accesses the screen memory and controls the character generator to provide the information for the CRT. Difficulties may be experienced with microprocessor stability when switching between the two different dot clock frequencies. Also, the cost of the two or more crystal oscillators and appropriate switching circuits can be quite high.

For example, in lower cost terminals, the clock frequency for the microprocessor is derived from the dot clock frequency. With certain microprocessors such as the 6502, the 6800, and the 6809 it is possible to have the microprocessor access the screen memory to add or delete characters during one phase of the microprocessor clock and have the controller access the memory for screen display during the other phase. This allows screen memory access without memory contention between the microprocessor and the controller, a desirable condition since memory contention leads to undesired flashes and streaks across the screen. The microprocessor must therefore operate at the character clock frequency and the microprocessor clock must change as the character clock changes. Providing a simple logic switch between two unrelated frequencies may occasionally lead to misoperation of the microprocessor and could even lead to a complete failure of the system. A solution to this problem of switching between the two frequencies would entail additional logic to only switch when the phase relationship was such that the microprocessor would not receive too short, or too long, a clock pulse to prevent misoperation. The addition of these parts plus a crystal oscillator is quite expensive. There is therefore a need in the art for a low cost, multi frequency dot clock generator for a VDT.

OBJECTS OF THE INVENTION

A principal object of the invention is to provide a novel video display terminal having a multi frequency dot clock.

Another object of the invention is to provide a low cost high reliability multi frequency dot clock generator for a video display terminal.

A further object of the invention is to provide a video display terminal that is readily operable with different dot clock frequencies.

BRIEF DESCRIPTION OF THE DRAWING

These and other objects of the invention will be apparent upon reading the following description in conjunction with the drawing, the single FIGURE of which comprises a partial block diagram of a video display terminal constructed in accordance with the invention.

DESCRIPTION OF THE PREFERRED EMBODIMENT

Referring to the drawings, a VDT 10 includes a CRT 12 having a horizontal deflection winding 14 and a vertical deflection winding 16 appropriately positioned with respect thereto for deflection of an electron beam generated therein across a phosphor covered target or screen on the faceplate thereof. CRT 12 and its operation are well-known in the art and will not be discussed in detail. CRT 12 can of course either be a monochrome or color tube.

A voltage controlled oscillator (VCO) 20 generates the dot clock frequency for the VDT. The output of VCO 20 is supplied to a divider 22 where the dot clock frequency is divided, by well-known means, by a factor from 6–9 to develop the clock signal for controller 26, microprocessor 24 and a character generator 28. This clock signal is referred to as the "character clock." Controller 26 and its companion microprocessor 24 are both well-known in VDTs. Controller 26 includes means for deriving the vertical and horizontal deflection signals from the character clock frequency in response to input control signals from microprocessor 24. As illustrated, character generator 28 may include a shift register 30 that is under control of controller 26, for developing the appropriate video information for display on the screen of CRT 12. A block 32, labelled other logic, is coupled to microprocessor 24 and is shown for the purpose of completeness. Block 32 is of no interest with respect to the present invention.

In accordance with the invention, a phase detector 34, of conventional construction, is supplied with an input from controller 26 (comprising the horizontal deflection signal) and an input from a conventional controlled reference oscillator 36 having a crystal 38 therein. The error signal output of phase detector 34 is supplied to a filter 40, consisting of a resistor 42 and a capacitor 44, and thence coupled to the input of VCO 20. With this arrangement, a change in display format, that is, number of characters per line is readily accomplished by a simple reprogramming of controller 26, which, as is well understood in the art, is sofware controlled. Consequently there is no need for a switch or for an additional crystal oscillator which could cause disruption of microprocessor operation. On the contrary, a software-induced change in controller 26 will generate an error signal at the output of filter 40, resulting in VCO 20 "ramping" up or down in frequency (and changing the dot clock frequency) in a smooth uninterrupted manner. The error signal is "nulled" when the new dot clock frequency is attained by VCO 20, since the horizontal deflection frequency is fixed. Thus controller 26 indirectly establishes the dot clock frequency.

Assume a dot clock of 16.589 Mhz. This may be divided by 9 to give a character clock of 1.8432 Mhz, which is also the microprocessor clock frequency. This may be divided by 102 by the controller to give a horizontal frequency of 18.07 Khz. This yields time for 80 displayed characters and a retrace time of 22 characters. The controller then divides the horizontal frequency by 301 lines (24 rows of characters with 12 lines in each for a total of 288 displayed lines) for a vertical frequency of 60.02 Hz. Assume that the horizontal frequency is locked to ½ the frequency of a small watch crystal operating at 36.14 Khz and a change to 132 characters per row is desired. The divide ratio is changed from 102 to 156 and the horizontal frequency would therefore become 11.815 Khz, which would not be frequency or phase locked to the 18.07 Khz reference. The phase detector would detect the error and ramp the VCO up in frequency until the horizontal frequency returned to 18.07 Khz, which will occur at a dot clock frequency of 25.371 Mhz and a character clock frequency of 2.819 Mhz. This timing would yield 132 displayed characters and 24 characters for the horizontal retrace time. The crystal used in the system of the invention to attain a 132 character display format is no larger or expensive than crystals used in commonplace watches.

Some prior art VDTs have a VCO and a phase lock loop for controlling the vertical deflection frequency to compensate for "rolling" of the picture caused by a divergence between the VDT vertical deflection frequency and the power line frequency. VDTs also have microprocessors coupled with the CRT controller for controlling Baud rate, reverse video and the like. In none of these VDTs is a VCO and a phase lock loop used for generating the dot clock frequency.

With the system of the invention, a conventional 80 character per line VDT may be readily and smoothly converted to a 132 character per line display without danger of disruption of the microprocessor. Whereas the prior art includes two crystal controlled oscillators and the necessary logic for switching between them, the present invention has a VCO, one crystal and a simple phase detector.

It is recognized that numerous modifications and changes in the described embodiment of the invention will be apparent to those skilled in the art without departing from its true spirit and scope. The invention is to be limited only as defined in the claims.

What is claimed is:

1. A video display terminal comprising:

a VCO for generating a dot clock signal;

means for dividing the dot clock signal for developing a character clock signal;

a microprocessor driven controller for supplying vertical and horizontal deflection signals to a CRT and video control data to a character generator, the deflection signals being derived by dividing the character clock signal by one of at least two different divide ratios, corresponding, respectively, to display formats of different numbers of characters per line;

a crystal controlled reference source; and phase detector means comparing signal inputs from the reference source and the controller and, in response to a change in said different divide ratios, developing and coupling an error signal to the VCO for changing the frequency of the dot clock signal so as to maintain the frequency of the deflection signals at a constant value.

2. The terminal of claim 1 wherein the signal output from said controller comprises the horizontal deflection signal for said CRT.

3. The terminal of claim 2 wherein said two divide ratios are such as to result in display formats of 80 and 132 characters per line.

4. A video display terminal including a CRT comprising:

a VCO for generating a dot clock signal;

a frequency divider coupled to said VCO for developing a character clock signal;

a character generator including a shift register supplying character information to said CRT under control of said VCO;

a microprocessor driven controller developing horizontal and vertical deflection signals for said CRT and video control data for said character generator, said deflection signals being derived by dividing the character clock signal by one of two different divide ratios, one divide ratio corresponding to a display format of 80 characters per line and the other divide ratio corresponding to a display format of 132 characters per line;

a crystal controlled oscillator reference source;

a phase detector having one input supplied with a signal from said reference source, another input supplied with said horizontal deflection signal and an output coupled to said VCO, whereby said phase detector, in response to a change in said divide ratios, develops an error signal between said horizontal deflection signal and the signal from said reference source, thus forcing the VCO to change the dot clock signal frequency to maintain the horizontal deflection frequency constant, thereby changing operation between said two display formats.

* * * * *